US006489925B2

(12) United States Patent
Thursby et al.

(10) Patent No.: US 6,489,925 B2
(45) Date of Patent: Dec. 3, 2002

(54) LOW PROFILE, HIGH GAIN FREQUENCY TUNABLE VARIABLE IMPEDANCE TRANSMISSION LINE LOADED ANTENNA

(75) Inventors: Michael H. Thursby, Palm Bay, FL (US); Kerry L. Greer, Palm Bay, FL (US); Young-Min Jo, Palm Bay, FL (US); Young-Ki Kim, Palm Bay, FL (US); Jay A. Kralovec, Melbourne, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 09/871,201

(22) Filed: May 31, 2001

(65) Prior Publication Data

US 2002/0024473 A1 Feb. 28, 2002

Related U.S. Application Data

(63) Continuation-in-part of application No. 09/643,302, filed on Aug. 22, 2000.

(51) Int. Cl.[7] ..... H01Q 1/36

(52) U.S. Cl. ..... 343/700 MS; 343/744; 343/844

(58) Field of Search ..... 343/700 MS, 728, 343/731, 744, 745, 850, 844, 845, 846, 848

(56) References Cited

U.S. PATENT DOCUMENTS

| | | | | |
|---|---|---|---|---|
| 2,688,083 A | | 8/1954 | Hills | |
| 3,742,393 A | | 6/1973 | Karp | |
| 3,925,738 A | | 12/1975 | Bates et al. | |
| 4,435,689 A | | 3/1984 | McDowell | |
| 4,465,988 A | | 8/1984 | Moats | |
| 4,764,771 A | | 8/1988 | Sterns | |
| 5,061,944 A | | 10/1991 | Powers et al. | |
| 5,790,080 A | | 8/1998 | Apostolos | |
| 6,025,811 A | | 2/2000 | Canora et al. | |
| 6,094,170 A | | 7/2000 | Peng | |
| 6,313,716 B1 | * | 11/2001 | Apostolos | 333/162 |
| 2001/0048394 A1 | * | 12/2001 | Apostolos | 343/700 MS |

OTHER PUBLICATIONS

Harrington, Roger F.; "Effect of Antenna Size on Gain, Bandwith, and Efficiency"; Journal of Research of the National Bureau of Standards—D. Radio Propagation; vol. 64D, No. 1, Jan.–Feb. 1960.

* cited by examiner

*Primary Examiner*—Don Wong
*Assistant Examiner*—Shih-Uhao Chen
(74) *Attorney, Agent, or Firm*—John L. DeAngelis, Jr.; Beusse Brownlee Bowdoin & Wolter, P.A.

(57) ABSTRACT

There is disclosed a meanderline-loaded antenna comprising a ground plane, a non-driven element affixed thereto, a driven or receiving element affixed thereto and a horizontal element between the driven and the non-driven elements. The non-driven and the driven elements comprise meanderline-loaded couplers that are oriented parallel to the ground plane and the horizontal element so as to present a low-profile meanderline-loaded antenna.

36 Claims, 10 Drawing Sheets

LOW PROFILE, HIGH GAIN FREQUENCY TUNABLE VARIABLE IMPEDANCE TRANSMISSION LINE LOADED ANTENNA

This patent application is a continuation-in-part of U.S. patent application bearing application No. 09/643,302 filed on Aug. 22, 2000.

BACKGROUND OF THE INVENTION

The present invention relates generally to antennae loaded by one or more meanderlines (also referred to as variable impedance transmission lines or slow wave transmission lines), and specifically to such an antenna providing multi-band and wide band operation and presenting a low profile.

It is generally known that antenna performance is dependent upon the antenna shape, the relationship between the antenna physical parameters (e.g., length for a linear antenna and diameter for a loop antenna) and the wavelength of the signal received or transmitted by the antenna. These relationships determine several antenna parameters, including input impedance, gain, directivity and the radiation pattern shape. Generally, the minimum physical antenna dimension must be on the order of a quarter wavelength of the operating frequency, which advantageously limits the energy dissipated in resistive losses and maximizes the energy transmitted. Quarter wave length and half wave length antenna are the most commonly used.

The burgeoning growth of wireless communications devices and systems has created a significant need for physically smaller, less obtrusive, and more efficient antennae that are capable of operation in multiple frequency bands and/or in multiple modes (i.e., different radiation patterns). Smaller packages do not provide sufficient space for the conventional quarter and half wave length antennae. As is known to those skilled in the art, there is an inverse relationship between physical antenna size and antenna gain, at least with respect to a single-element antenna. Increased gain requires a physically larger antenna, while users continue to demand physically smaller antennae. As a further constraint, to simplify the system design and strive for minimum cost, equipment designers and system operators prefer to utilize antennae capable of efficient multi-frequency and/or wide bandwidth operation. Finally, it is known that the relationship between the antenna frequency and the antenna length (in wavelengths) determines the antenna gain. That is, the antenna gain is constant for all quarter wavelength antennae of a specific geometry (i.e., at that operating frequency where the effective antenna length is a quarter of a wavelength).

One prior art technique that addresses some of these antenna requirements is the so-called "Yagi-Uda" antenna, which has been successfully used for many years in applications such as the reception of television signals and point-to-point communications. The Yagi-Uda antenna can be designed with high gain (which is directly related to the antenna directivity) and a low voltage-standing-wave ratio (i.e., low losses) throughout a narrow band of contiguous frequencies. It is also possible to operate the Yagi-Uda antenna in more than one frequency band, provided that each band is relatively narrow and that the mean frequency of any one band is not a multiple of the mean frequency of another band. That is, a Yagi-Uda antenna for operation at multiple frequencies can be constructed so long as the operational frequencies are not harmonically related.

Specifically, the Yagi-Uda antenna includes a single element driven from a source of electromagnetic radio frequency (RF) radiation. That driven element is typically a half-wave dipole. In addition to the half-wave dipole element, the antenna includes a plurality of parasitic elements, including a reflector element on one side of the dipole and a plurality of director elements on the other side of the dipole. The director elements are usually disposed in a spaced-apart relationship in the direction of transmission (or in the direction from which the desired signal is received when operating in the receive mode). The reflector element is disposed on the side of the dipole opposite from the array of director elements. Certain improvements in the Yagi-Uda antenna are set forth in U.S. Pat. No. 2,688,083 (disclosing a Yagi-Uda antenna configuration to achieve coverage of two relatively narrow non-contiguous frequency bands), and U.S. Pat. No. 5,061,944 (disclosing the use of a full or partial cylinder partially enveloping the dipole element).

U.S. Pat. No. 6,025,811 discloses an invention directed to a dipole array antenna having two dipole radiating elements. The first element is a driven dipole of a predetermined length and the second element is an unfed dipole of a different length, but closely spaced from the driven dipole and excited by near-field coupling. This antenna provides improved performance characteristics at higher microwave frequencies.

One basic antenna model commonly used in many applications today is the half-wave dipole antenna. The radiation pattern is the familiar donut shape with most of the energy radiated uniformly in the azimuth direction and little radiation in the elevation direction. The personal communications (PCS) band of frequencies extends from 1710 to 1990 MHz and 2110 to 2200 MHz. A half-wavelength dipole antenna is approximately 3.11 inches long at 1900 MHz, 3.45 inches long at 1710 MHz 2.68 inches long at 2200 MHz, and has a typical gain of a 2.15 dBi. A derivative of the half-wavelength dipole is the quarter-wavelength monopole antenna located above a ground plane. The physical antenna length is a quarter-wavelength, but the ground plane influences the antenna characteristics to resemble a half-wavelength dipole. Thus, the radiation pattern for such a monopole above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis with a gain of approximately 3.1 dBi. At 1900 MHz, this antenna has a diameter of about 2 inches. The typical loop antenna input impedance is 50 ohms, providing good matching characteristics. Another conventional antenna is the patch, which provides directional hemispherical coverage with a gain of approximately 3 dBi. Although small compared to a quarter or half wave length antenna, the patch antenna has a low radiation efficiency.

BRIEF SUMMARY OF THE INVENTION

The present invention is an antenna comprising a ground plane, one or more conductive elements, including a horizontal element and at least two spaced apart vertical elements each connected to the horizontal element by a meanderline coupler. The meanderline coupler has an effective electrical length through the dielectric medium that influences the overall effective electrical length, operating characteristics and pattern shape of the antenna. Further, the use of multiple vertical elements or the use of multiple meanderline couplers on a single vertical element provides controllable operation in multiple frequency bands. An antenna comprising meanderline couplers has a smaller physical size, yet exhibits enhanced performance over a conventional dipole. Further, the operational bandwidth is greater than typically encountered with a patch antenna. Finally, an antenna constructed with two properly-oriented horizontal elements and therefore four meanderline couplers (two for each horizontal element) in accordance with the teachings of the present invention offers polarization diversity, including providing a circularly polarized signal. Polarization diversity depends on the phase relationship between the signals input to the two antennae and the physical orientation of the radiating elements. According to the antenna reciprocity theorem, the antenna exhibits the same polarization characteristics in the receiving mode as it does in the transmitting mode. For example, circular polarization is achieved by coupling two meanderline antennae together wherein the meanderline antennae are oriented 90 degrees orthogonally to each other and further wherein the transmitted or received signal is combined using a hybrid phase combiner. A single meanderline antenna provides linear polarization of the transmitted signal and receives linear polarized signals.

In one embodiment, a meanderline coupled antenna operates in two frequency bands, with a unique antenna pattern for each band (i.e., in one band the antenna has a omnidirectional donut radiation pattern (referred to herein as the monopole mode) and in the other band the majority of the radiation is emitted in a hemispherical pattern (referred to as the loop mode). According to the teachings of the present invention, the antenna comprises horizontally stacked meanderline couplers providing a meanderline-loaded antenna having a lower profile (i.e., a smaller vertical height) than the prior art meanderline-loaded antennae. The incorporation of antennae into mobile and hand-held devices requires an antenna having a low profile configuration so that the antenna occupies less space than antennae constructed according to the teachings of the prior art.

BRIEF DESCRIPTION OF THE DRAWINGS

The present invention can be more easily understood and the further advantages and uses thereof more readily apparent, when considered in view of the description of the preferred embodiments and the following figures in which.

DETAILED DESCRIPTION OF THE PREFERRED EMBODIMENTS

Figure 1:
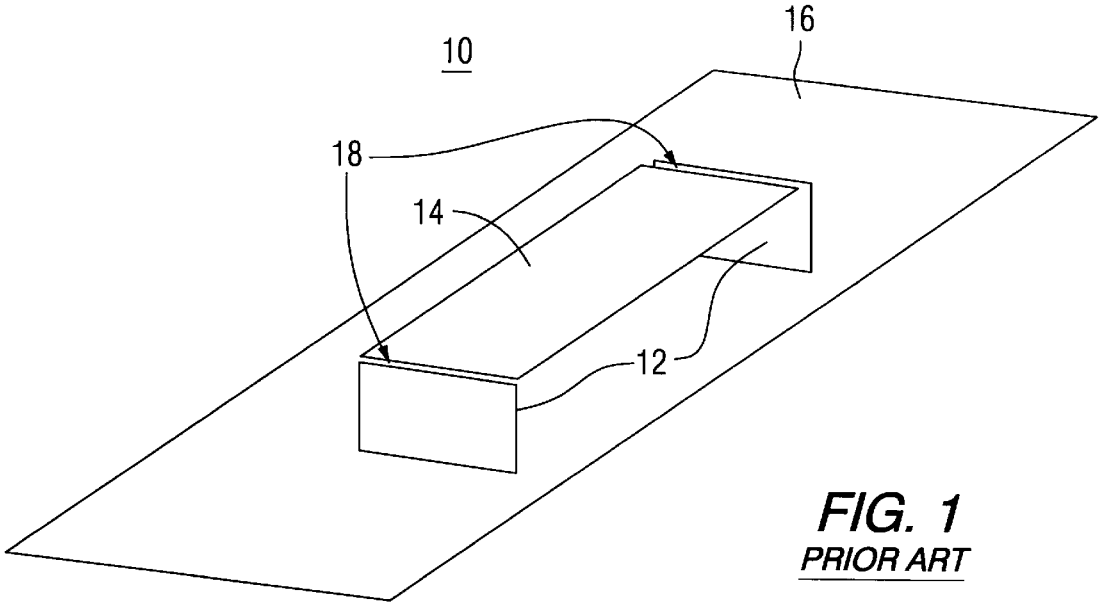
FIG. 1 PRIOR ART
FIG. 1 is a perspective view of a meanderline-loaded antenna of the prior art.

Before describing in detail the particular multi-band meanderline-loaded antenna constructed according to the teachings of the present invention, it should be observed that the present invention resides primarily in a novel and non-obvious combination of apparatus related to meanderline-loaded antennae and antenna technology in general. Accordingly, the hardware components described herein have been represented by conventional elements in the drawings and in the specification description, showing only those specific details that are pertinent to the present invention, so as not to obscure the disclosure with structural details that will be readily apparent to those skilled in the art having the benefit of the description herein.

Figure 2:
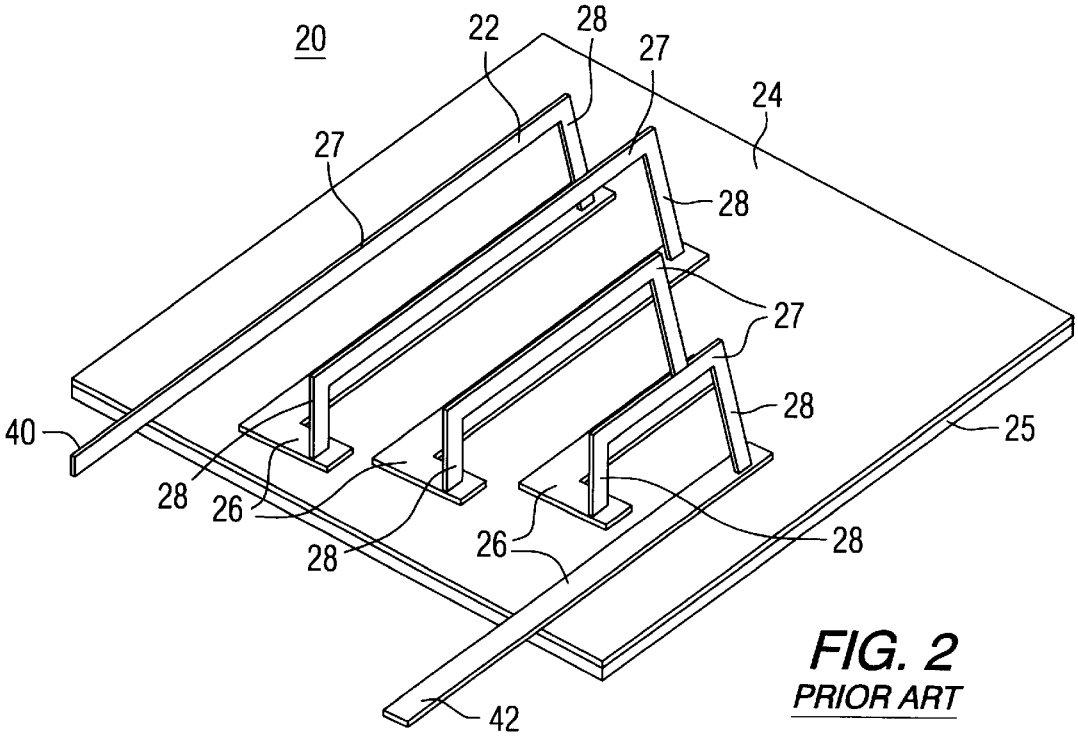
FIG. 2 PRIOR ART
FIG. 2 is a perspective view of a prior art meanderline conductor used as an element coupler in the meanderline-loaded antenna of FIG. 1.

FIGS. 1 and 2 depict a prior art meanderline-loaded antenna to which the teachings of the present invention can be advantageously applied to provide operation in multiple frequency bands and in multiple simultaneous modes, while maintaining optimum input impedance characteristics.

A schematic representation of a meanderline-loaded antenna 10, also known as a variable impedance transmission line antenna, is shown in a perspective view in FIG. 1. Generally speaking, the meanderline-loaded antenna 10 includes two vertical conductors 12, a horizontal conductor 14, and a ground plane 16. The vertical conductors 12 are physically separated from the horizontal conductor 14 by gaps 18, but are electrically connected to the horizontal conductor 14 by two meanderline couplers, one for each of the two gaps 18, to thereby form an antenna structure capable of radiating and receiving RF (radio frequency) energy. The meanderline couplers electrically bridge the gaps 18 and, in one embodiment, have controllably adjustable lengths for changing the characteristics of the meanderline-loaded antenna 10. In one embodiment of the meanderline coupler, segments of the meanderline can be switched in or out of the circuit quickly and with negligible loss, to change the effective length of the meanderline couplers, thereby changing the antenna characteristics. The switching devices are located in high impedance sections of the meanderline couplers, thereby minimizing the current through the switching devices, resulting in very low dissipation losses in the switching device and maintaining high antenna efficiency.

The operational parameters of the meanderline-loaded antenna 10 are affected by the wavelength of the input signal as related to the sum of the meanderline coupler lengths plus the antenna element lengths. According to the antenna reciprocity theorem, the antenna operational parameters are also substantially affected by the receiving signal frequency. Two of the various modes in which the antenna can operate are discussed herein below.

Although illustrated in FIG. 1 as having generally rectangular plates, it is known to those skilled in the art that the vertical conductors 12 and the horizontal conductor 14 can be constructed from a variety of conductive materials. For instance, thin metallic conductors having a length significantly greater than their width, could be used as the vertical conductors 12 and the horizontal conductor 14. Single or multiple lengths of heavy gauge wire or conductive material in a filamental shape could also be used.

FIG. 2 shows a perspective view of a meanderline coupler 20 constructed for use in conjunction with the meanderline-loaded antenna 10 of FIG. 1. Two meanderline couplers 20 are generally required for use with the meanderline-loaded antenna 10; one meanderline coupler 20 bridging each of the gaps 18 illustrated in FIG. 1. However, it is not necessary for the two meanderline couplers to have the same physical length. The meanderline coupler 20 of FIG. 2 is a slow wave meanderline element (or variable impedance transmission line) in the form of a folded transmission line 22 mounted on a substrate 24, which is in turn mounted on a plate 25. In one embodiment, the transmission line 22 is constructed from microstrip line. Sections 26 are mounted close to the substrate 24; sections 27 are spaced apart from the substrate 24. In one embodiment as shown, sections 28, connecting the sections 26 and 27, are mounted orthogonal to the substrate 24. The variation in height of the alternating sections 26 and 27 from the substrate 24 gives the sections 26 and 27 different impedance values with respect to the substrate 24. As shown in FIG. 2, each of the sections 27 is approximately the same distance above the substrate 24. However, those skilled in the art will recognize that this is not a requirement for the meanderline coupler 20. Instead, the various sections 27 can be located at differing distances above the substrate 24. Such modifications change the electrical characteristics of the coupler 20 from the embodiment employing uniform distances. As a result, the characteristics of the antenna employing the coupler 20 is utilized also change. The impedance presented by the meanderline coupler 20 can be changed by changing the material or thickness of the microstrip substrate or by changing the width of the sections 26, 27 or 28. In any case, the meanderline coupler 20 must present a controlled (but controllably variable if the embodiment so requires) impedance.

The sections 26 are relatively close to the substrate 24 (and thus the plate 25) to create a lower characteristic impedance. The sections 27 are a controlled distance from the substrate 24, wherein the distance determines the characteristic impedance of the section 27 in conjunction with the other physical characteristics of the folded transmission line 22, as well as the frequency characteristics of the folded transmission line 22.

The meanderline coupler 20 illustrated in FIG. 2 is constructed using microstrip technology. Those skilled in the art recognize that stripline technology can also be utilized to construct slow wave meanderline couplers. As expected, the length and shape of the conductors in the stripline embodiment would be dissimilar to those shown in FIG. 2, recognizing the different physical principles governing the characteristics of stripline and microstrip.

Figure 3A:
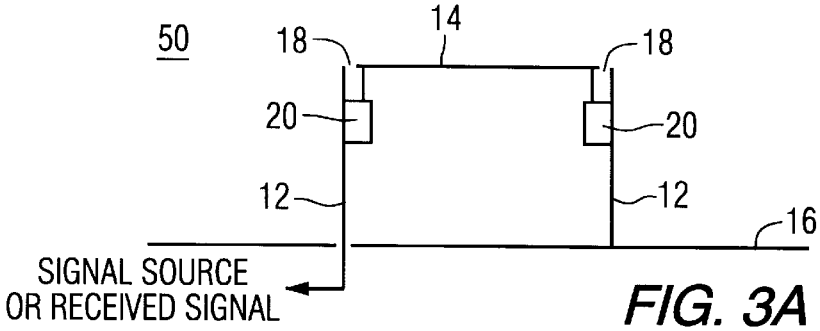
FIG. 3A PRIOR ART
FIGS. 3A through 3B illustrate two embodiments for placement of the meanderline couplers relative to the antenna elements.
Figure 3B:
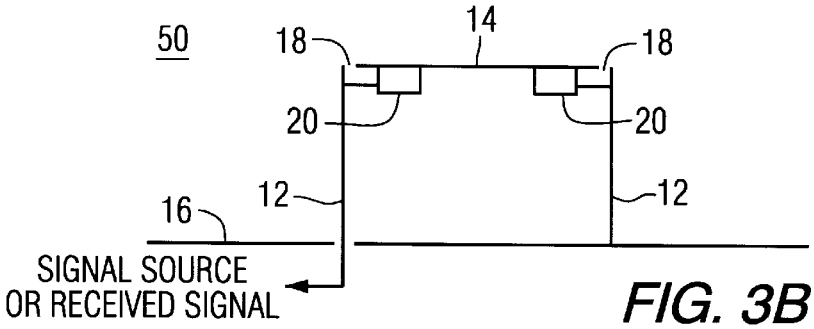
FIG. 3B PRIOR ART

The meanderline coupler 20 includes terminating points 40 and 42 for connection to the elements of the meanderline-loaded antenna 10. Specifically, FIG. 3A illustrates two meanderline couplers 20, one affixed to each of the vertical conductors 12 such that the vertical conductor 12 serves as the plate 25 from FIG. 2, so as to form a meanderline-loaded antenna 50. One of the terminating points shown in FIG. 2, for instance the terminating point 40, is connected to the horizontal conductor 14 and the terminating point 42 is connected to the vertical conductor 12. The second of the two meanderline couplers 20 illustrated in FIG. 3A is configured in a similar manner. FIG. 3B shows the meanderline couplers 20 affixed to the horizontal conductor 14, such that the horizontal conductor 14 serves as the plate 25 of FIG. 2. As in FIG. 3A, the terminating points 40 and 42 are connected to the vertical conductors 12 and the horizontal conductor 14, respectively, so as to interconnect the vertical conductors 12 and the horizontal conductor 14 across the gaps 18. In both FIGS. 3A and 3B, one of the vertical conductors, for example the vertical conductor 12, includes the signal source feed point when operative in the transmit mode or the point from which the received signal is taken when operative in the receiving mode.

Figure 4:
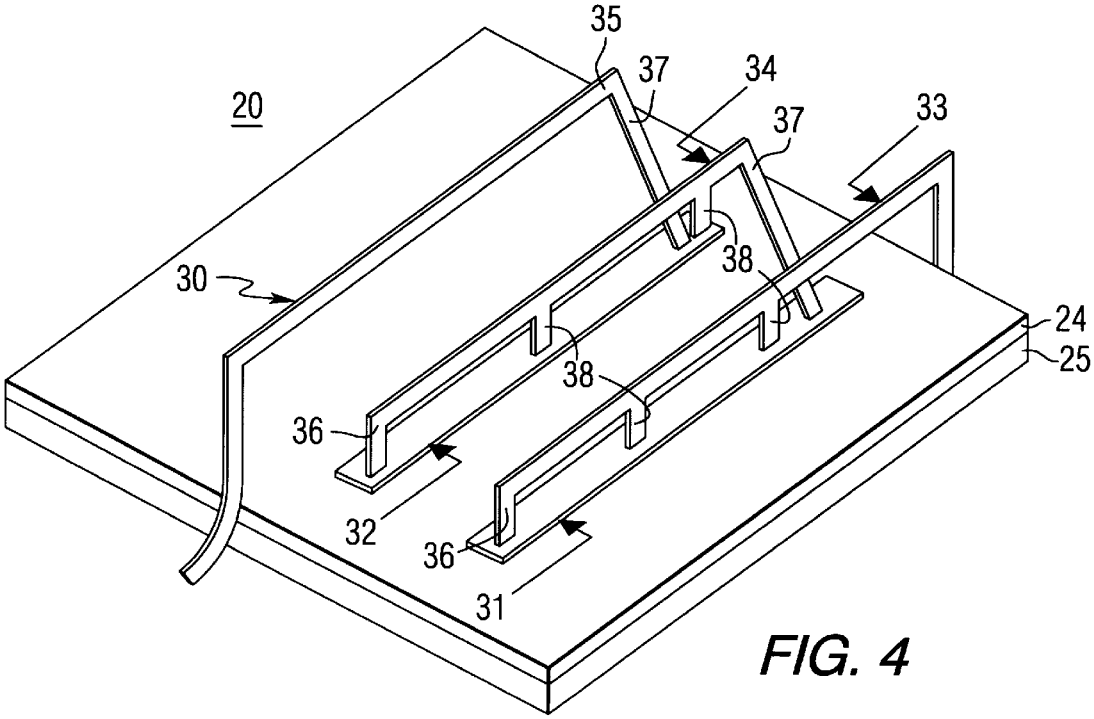
FIG. 4 shows another embodiment of a meanderline coupler.

FIG. 4 is a representational view of a second embodiment of the meanderline coupler 20, including low-impedance sections 31 and 32 and relatively higher-impedance sections 33, 34, and 35. The low impedance sections 31 and 32 are located in a parallel spaced apart relationship to the higher impedance sections 33 and 34. The sequential low impedance sections 31 and 32 and the higher impedance sections 33, 34, and 35 are connected by substantially orthogonal sections 36 and by diagonal sections 37. The FIG. 4 embodiment includes shorting switches 38 connected between the adjacent low and higher impedance sections 32/34 and 31/33. The shorting switches 38 provide for electronically switchable control of the meanderline coupler length. As discussed above, the length of the meanderline coupler 20 has a direct impact on the frequency characteristics of the meanderline-loaded antenna 50 to which the meanderline couplers 20 are attached, as shown in FIGS. 3A and 3B. As is well known in the art, there are several alternatives for implementing the shorting switches 38, including mechanical or MEMS (microelectromechanical system) switches or electronically controllable switches, such as pin diodes. In the embodiment of FIG. 4, all of the low-impedance sections 31 and 32 and the higher-impedance sections 33, 34, and 35 are of approximately equal length, although this is not necessarily required, according to the teachings of the present invention.

The operating mode of the meanderline-loaded antenna 50 (in FIGS. 3A and 3B) depends upon the relationship between the operating frequency and the electrical length of the entire antenna, including the meanderline couplers 20. Thus the meanderline-loaded antenna 50, like all antennae, has an effective electrical length, causing it to exhibit operational characteristics determined by the transmit signal frequency in the transmit mode and the received frequency in the receiving mode. That is, different operating frequencies excite the antenna so that it exhibits different operational characteristics, including different antenna radiation patterns. For example, a long wire antenna may exhibit the characteristics of a quarter wavelength monopole at a first frequency and exhibit the characteristics of a full-wavelength dipole at a frequency of twice the first frequency.

In accordance with the teachings of the present invention, the length of one or more of the meanderline couplers 20 can be changed (as discussed above), altering the effective antenna electrical length relative to the operating frequency, and in this way change the operational mode without changing the input frequency.

Figure 5:
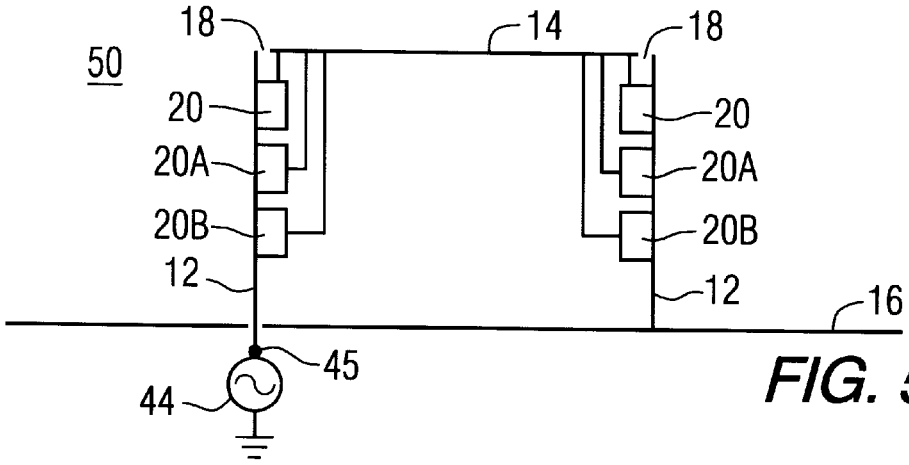
FIG. 5 illustrates the use of a selectable plurality of meanderline couplers with the meanderline-loaded antenna of FIG. 1.

Still further, a plurality of meanderline couplers 20 of different lengths can be connected between the horizontal conductor 14 and the vertical conductors 12. Two matching meanderline couplers 20 on opposing sides of the horizontal conductor 14 are selected to interconnect the horizontal conductor 14 and the vertical conductors 12. Such an embodiment is illustrated in FIG. 5 including matching meanderline couplers 20, 20A and 20B and an input signal source 44. In the receiving mode the signal source 44 is inactive, and the received signal is available at the terminal 45. A controller (not shown in FIG. 5) is connected to the meanderline couplers 20, 20A and 20B for selecting the operative matching couplers. Well-known switching arrangement can activate the selected meanderline coupler to connect the horizontal conductor 14 and the vertical conductors 12. The vertical conductor 12 is responsive to the input signal in the transmit mode at the terminal 45 (and providing the received signal at the terminal 45 in the receive mode) is sometime referred to as the driven element or driven conductor. The other vertical conductor 12 is referred to as the non-driven element or non-driven conductor. In another embodiment, both vertical conductors 12 can be driven, with the radiated signal formed as a composite signal depending on the amplitude and phase relationship of the two driving signals.

Figure 6:
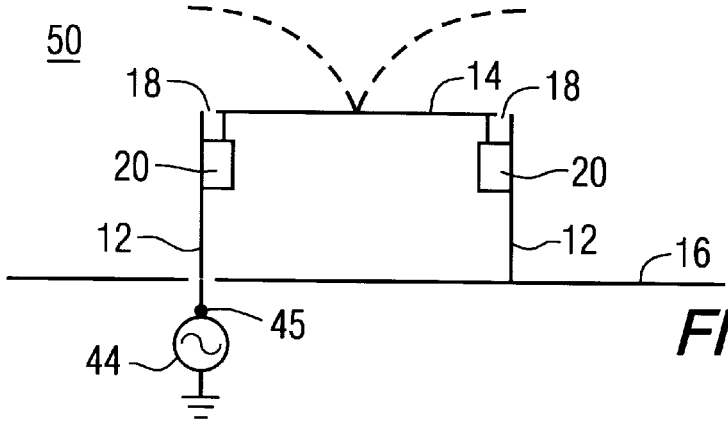
FIGS. 6 through 9 illustrate exemplary operational modes for a meanderline-loaded antenna.
Figure 7:
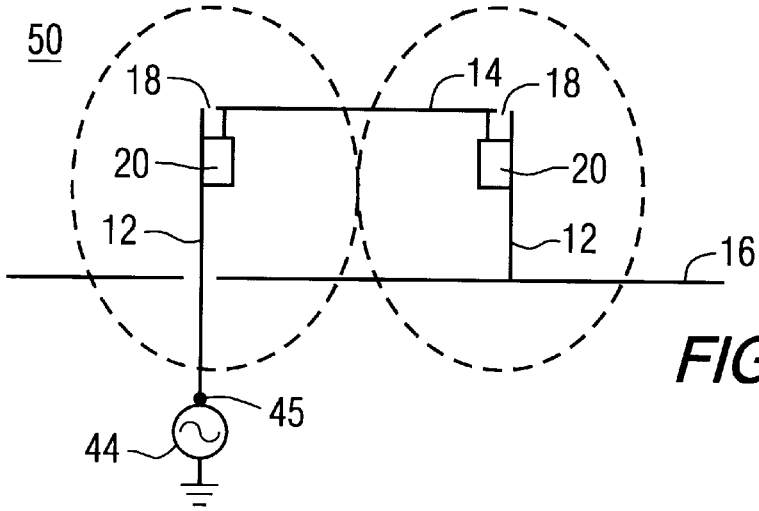

Turning to FIGS. 6 and 7, there is shown the current distribution (FIG. 6) and the antenna electric field radiation pattern (FIG. 7) for the meanderline-loaded antenna 50 operating in a monopole or half wavelength mode as driven by an input signal source 44. That is, in this mode, at a frequency of between approximately 800 and 900 MHz, the effective electrical length of the meanderline couplers 20, the horizontal conductor 14 and the vertical conductors 12 is chosen such that the horizontal conductor 14 has a current null near the center and current maxima at each edge. As a result, a substantial amount of radiation is emitted from the vertical conductors 12, and little radiation is emitted from the horizontal conductor 14. The resulting field pattern has the familiar omnidirectional donut shape as shown in FIG. 7.

Those skilled in the art will realize that a frequency of between 800 and 900 MHz is merely exemplary. The antenna operational characteristics change when excited by signals at other frequencies because the relationship between the antenna component geometries and the signal frequency changes. Further, the dimensions, geometry and material of the antenna components (the meanderline couplers 20, the horizontal conductor 14 and the vertical conductors 12) can be modified by the antenna designer to create an antenna having different antenna characteristics at other frequencies or frequency bands.

Figure 8:
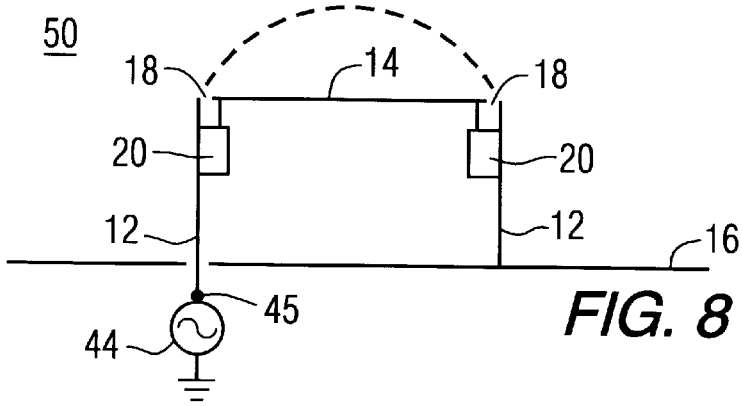
Figure 9:
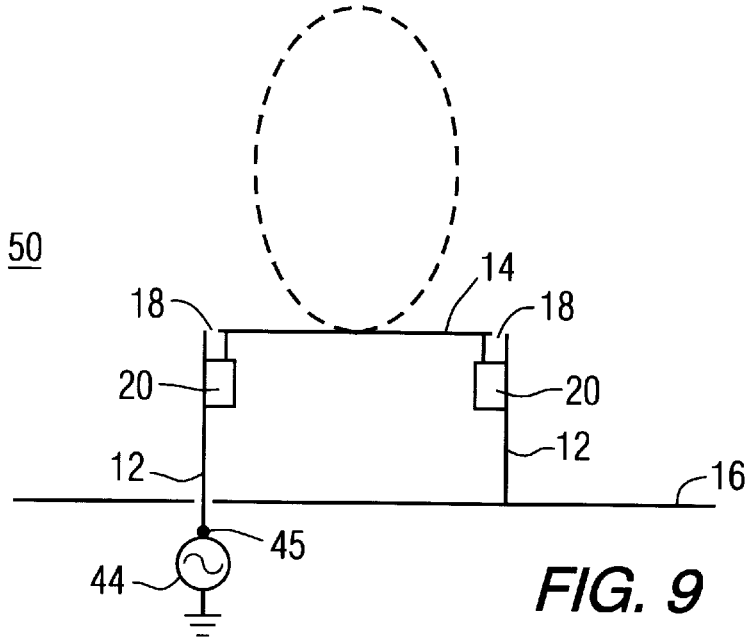

A second exemplary operational mode for the meanderline-loaded antenna 50 is illustrated in FIGS. 8 and 9. This mode is the so-called loop mode, operative when the ground plane 16 is electrically large compared to the effective length of the antenna. In this mode the current maximum occurs approximately at the center of the horizontal conductor 14 (see FIG. 8) resulting in an electric field radiation pattern as illustrated in FIG. 9. The antenna characteristics displayed in FIGS. 8 and 9 are based on an antenna of the same electrical length (including the length of the meanderline couplers 20) as the antenna parameters depicted in FIGS. 6 and 7. Thus, at a frequency of approximately 800 to 900 MHz, the antenna displays the characteristics of FIGS. 6 and 7, and for a signal frequency of approximately 1.5 GHz, the same antenna displays the characteristics of FIGS. 8 and 9. By changing the antenna element electrical lengths, monopole and loop characteristics can be attained at other frequency pairs. Generally, the meanderline loaded antenna exhibits monopole-like characteristics at a first frequency and loop-like characteristics at a second frequency where there is a loose relationship between the two frequencies, however, the relationship is not necessarily a harmonic relationship. A meanderline loaded antenna constructed according to FIG. 1 and as further described hereinbelow, exhibits both monopole and loop mode characteristics, while typically most prior art antennae operate in only a loop mode or in monopole mode. That is, if the antenna is in the form of a loop, then it exhibits a loop pattern only. If the antenna has a monopole geometry, then only a monopole pattern can be produced. In contrast, a meanderline loaded antenna according to the teachings of the present invention exhibits both monopole and loop characteristics.

Advantageously, the antenna of the present invention can also be operated simultaneously in two different modes dependent on the input signal frequency, that is, in the loop mode and the monopole mode. For example, a meanderline loaded antenna can be fed from a single input feed point with a composite signal carrying information on two different frequencies. In response, the meanderline loaded antenna radiates each signal in a different mode, i.e., one signal is radiated in the loop mode and the other signal is radiated in the monopole mode. For instance, a signal at about 800 MHz radiates in the monopole mode and simultaneously a signal at about 1500 MHz radiates in the loop mode. But, in one embodiment the length of the top plate is less than a quarter wavelength. In the monopole mode the radiation is directed primarily toward the horizon in an omnidirectional pattern, with a gain of approximately 2.5 dBi within the frequency band of approximately 806 to 960 MHz. In the loop mode the radiation is directed primarily overhead at a gain of approximately 4 dBi, within a frequency band of approximately 1500 to 1650 MHz.

By changing the geometrical features of a meanderline loaded antenna constructed according to the teachings of the present invention, the antenna can be made operative in other frequency bands, including the FCC-designated ISM (Industrial, Scientific and Medical) band of 2400 to 2497 MHz.

Proper orientation and feeding of two antennae constructed according to the teachings of the present invention can produce a composite signal having elliptical polarization. For example, two antennae oriented at 90 degrees with respect to each other and having equal gain in each dimension, produce a circularly polarized signal, which is useful for satellite communications, when the two input signals are properly related.

Figure 10:
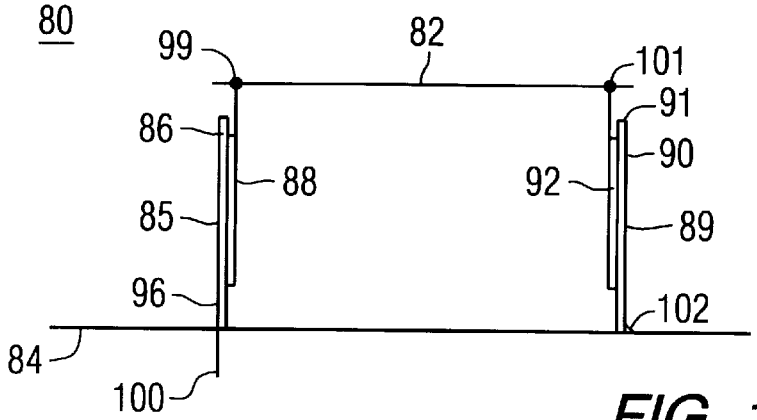
FIG. 10 illustrates a meanderline-loaded antenna constructed according to the teachings of the present invention.

FIG. 10 illustrates another embodiment of a meanderline-loaded antenna, specifically a meanderline-loaded antenna 80, including a horizontal conductor 82 and a ground plane 84. A meanderline coupler 85 is formed by wrapping a conductive strand 96 around dielectric substrates 86 and 88. A meanderline coupler 89 is formed by wrapping a conductive strand 91 around dielectric substrates 90 and 92. The dielectric substrates 86, 88, 90 and 92 can be formed of ceramics, resins, Kapton, K-4, etc. In one embodiment air can serve as the dielectric material, i.e., an air core meanderline.

Figure 11:
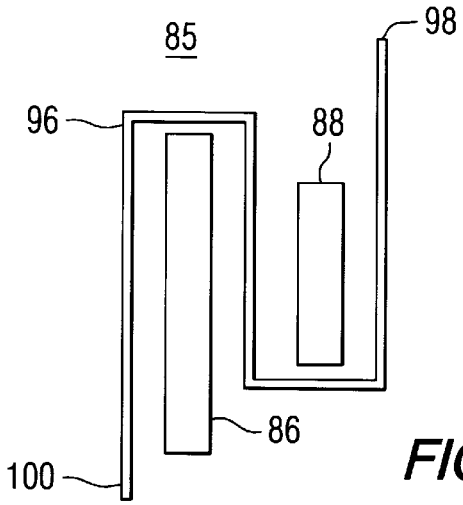
FIGS. 11 through 14 illustrate meanderline couplers for use in the meanderline-loaded antenna of FIG. 10.

FIG. 11 illustrates the substrates 86 and 88 in a more detailed exploded view, showing the conductive strand 96 passing to one side of the substrate 86, above the substrate 86, between the substrates 86 and 88, below the substrate 88, and finally to the right of substrate 88. The terminal end 98 of the conductive strand 96 is attached to the top plate 82 at a point 99, as illustrated in FIG. 10. The input signal to the meanderline-loaded antenna 88 is provided at a terminal end 100 of the conductive strand 96. Note from FIG. 10 that a segment of the conductive strand 96 passes through an opening in the ground plane 84, thus allowing connection of the terminal end 100 to an input signal. As is known by those skilled in the art, when the meanderline-loaded antenna 80 operates in the receive mode, the received signal is provided at the terminal end 100, from where it is input to the demodulating and recovery circuitry. According to FIG. 10, the conductive strand 91 passing between and around the substrates 90 and 92 is electrically connected to the horizontal conductor 82 at a point 101 and to the ground plane 84, for example, by a solder connection 102 as shown. Although both of the conductive strands 91 and 96 are shown as forming only a single loop around their respective dielectric substrates, those skilled in the art realize that multiple loops can be formed about the substrates 86, 88, 90 and 92. The conductive strand 98 and the substrates 86 and 88 are joined by any of the well-known adhesives applied to the mating surfaces or by the use of a fastener (not shown) passing through mating holes in the substrates 86 and 88 and the conductive strand 96. The meanderline coupler 89 is formed in a similar fashion.

Figure 12:
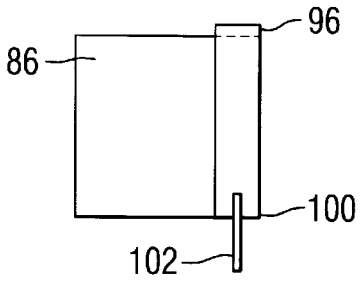

FIG. 12 is a side view of the meanderline-loaded antenna 80 of FIG. 10. In particular, FIG. 12 shows the outside surface of the substrate 86 and the conductive strand 96. The terminal end 100 is also shown. In this embodiment the conductive strand 96 is formed as a ribbon and a circular conductor 102 (a coaxial cable, for example) is attached to the terminal end 100 for providing the input signal to the meanderline-loaded antenna 80 when operative in the transmit mode. As shown, the width of the conductive strand is less than the width of the dielectric substrate 86.

Figure 13:
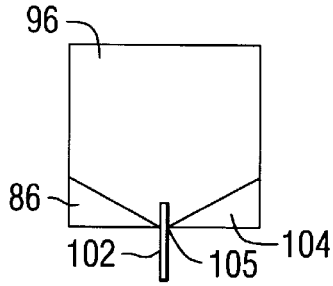

FIG. 13 illustrates another embodiment showing the outside surface of the substrate 86 and the conductive strand 96. In this embodiment, that portion of the conductive strand on the outside surface of the substrate 86 transitions from the ribbon shape to a simple polygon, with a tapered edge 104. The circular conductor 102 is electrically connected to the conductive strand 96 at the taper point 105 for providing the input signal to the meanderline-loaded antenna 80 when operative in the transmit mode or for providing the output signal when operative in the receive mode.

Figure 14:
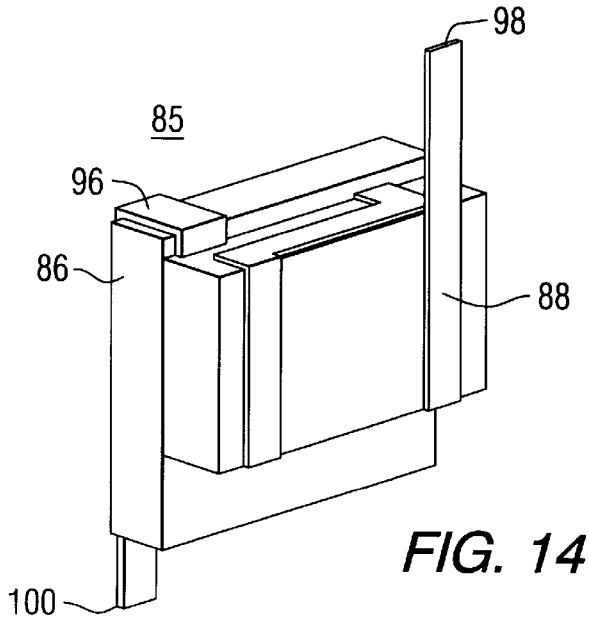

FIG. 14 illustrates another embodiment of the meanderline coupler 85, including the substrates 86 and 88 and the conductive strand 96. Note that in this embodiment the conductive strand 96 passes between the substrates 86 and 88. After passing along the bottom surface of the substrate 88, the conductive strand 96 runs vertically along the inside surface of the substrate 88 and then horizontally along the top surface of the substrate 88. The conductive strand 96 then passes between the substrates 86 and 88 to the bottom surface of the substrate 88, after which it passes along the front surface thereof, terminating at the end point 98 for connection to the top plate 82 at a point 99 (See FIG. 10.) The meanderline coupler 89 is constructed in a similar fashion.

Figure 15:
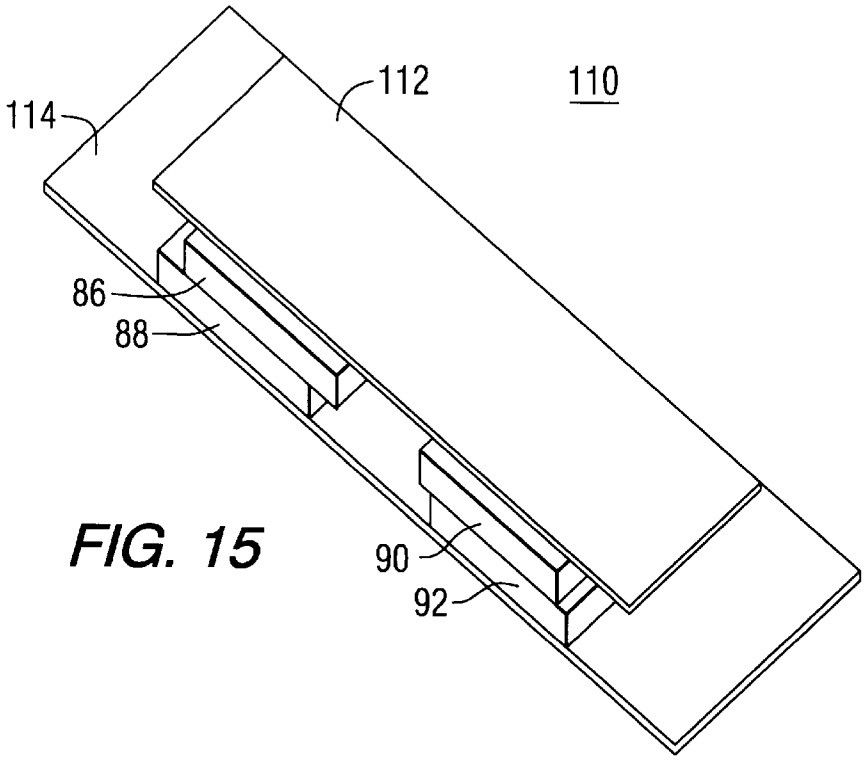
FIG. 15 illustrates a low profile embodiment of a meanderline-loaded antenna constructed according to the teachings of the present invention.

Although the meanderline loaded antennae discussed above embody certain advantageous characteristics, it is desirable to further reduce the antenna size, while retaining its beneficial features. FIG. 15 illustrates another embodiment of the present invention, a meanderline-loaded antenna 110 wherein the substrates 86, 88, 90 and 92 are oriented horizontally below a top plate 112, thus reducing the antenna height. The meanderline-loaded antenna 110 further includes a ground plane 114. The conductive strand 96 associated with the substrates 86 and 88 (see FIG. 10) is connected to a signal source, or a receiver, not shown in FIG. 15. Similarly, the conductive strand 91 associated with the substrates 90 and 92 is connected to the ground plane 114.

For the meanderline-loaded antenna 110 to exhibit similar antenna performance parameters (especially gain and directivity) to the meanderline-loaded antenna 80 of FIG. 10, it is know by those skilled in the art that the two antennae should have a similar volume. The volume of both of the meanderline-loaded antennae 80 and 110 is calculated as the product of the length, width, and height. Since the meanderline-loaded antenna 110 has a smaller height, the meanderline couplers 80 must be separated by a distance greater than the separation between the meanderline couplers 20 of FIG. 10 if similar performance characteristics are to be achieved. Also, it is known that maximum antenna gain is achieved by maximizing the antenna volume (expressed in cubic wavelengths). The ground plane size in general also affects the size of the antenna pattern. As a result, the ground plane is customized according to the specific implementation requirements of the meanderline loaded antenna.

Figure 16:
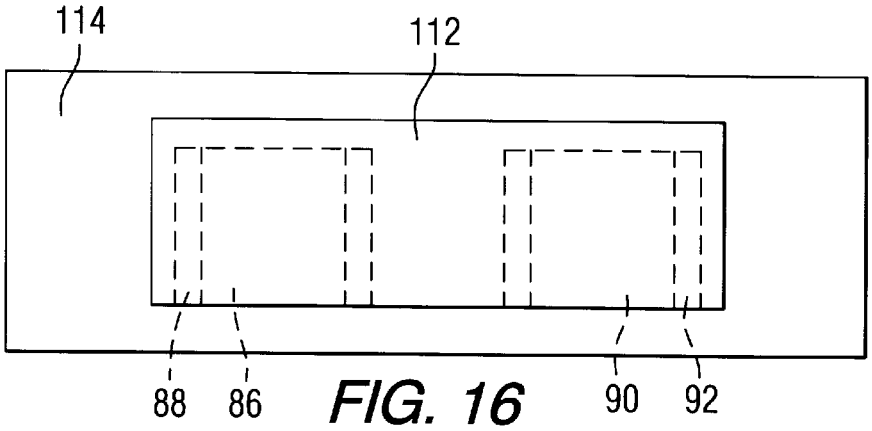
FIGS. 16 and 17 illustrate the placement of the meanderline couplers for use with the meanderline-loaded antenna of FIG. 15.
Figure 17:
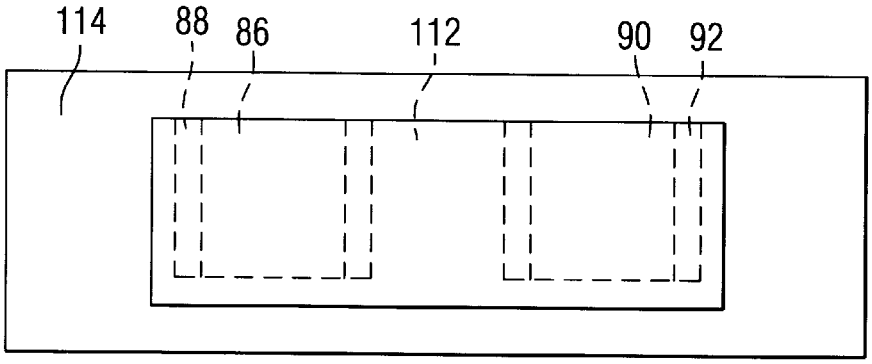

The top views of FIGS. 16 and 17 illustrate additional embodiments of the meanderline-loaded antenna 110, wherein the substrates 86, 88, 90 and 92 are shifted from their positions shown in FIG. 15. In FIG. 16 substrates 86, 88, 90 and 92 are flush with the forward edge of the top plate 112; in FIG. 17 the substrates 86, 88, 90 and 92 are flush with the rear edge of the top plate 112.

In one embodiment of the meanderline-loaded antenna 110, the vertical distance between the ground plane 114 and the horizontal conductor 112 is approximately two to four millimeters.

Figure 18:
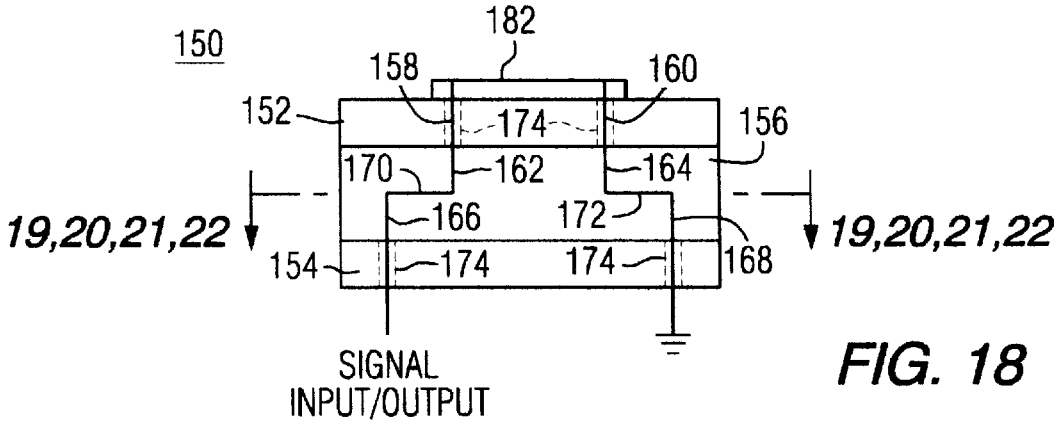
FIG. 18 illustrates another embodiment of a low profile meanderline-loaded antenna constructed according to the teachings of the present invention.

Another low-profile embodiment of a meanderline-loaded antenna constructed according to the teachings of the present invention is illustrated in FIG. 18. The FIG. 18 embodiment is smaller than previous embodiments described above; in one embodiment, less than 3 mm thick. The antenna utilizes commonly available dielectrics and is easily manufactured. The antenna has equal or better gain and pattern performance compared to conventional monopole and dipole antennae. A meanderline-loaded antenna 150 of FIG. 18 comprises dielectric substrates 152, 154 and 156. Meanderlines 158 and 160 each have two primarily vertical segments 162/166 and 164/168, respectively, as shown in FIG. 18, and two primarily horizontal segments 170 and 172. Each of the vertical segments 162, 164, 166 and 168 passes through a via 174 in the substrates 152 and 154 as shown. Both of the vertical segments 162 and 164 are electrically connected to a radiating element 182. As shown, the vertical segment 166 serves as the signal input or output point, and the vertical segment 168 is connected to ground. By placing the meanderlines horizontally, rather than vertically, the overall antenna height is reduced.

Figure 19:
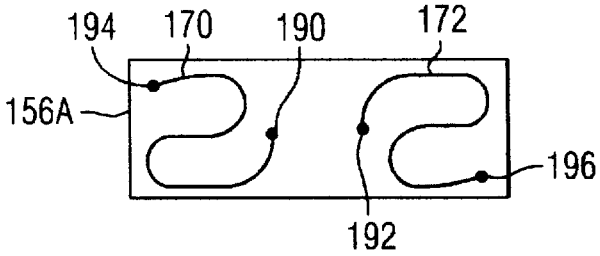
FIGS. 19 through 22 illustrate exemplary meanderline couplers for use with the meanderline-loaded antenna of FIG. 18.
Figure 20:
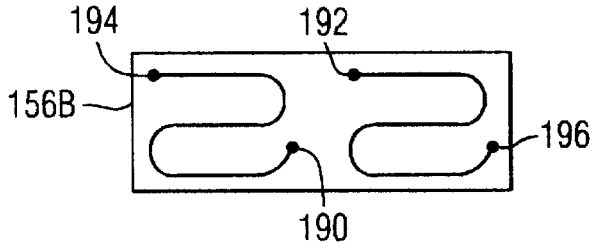
Figure 21:
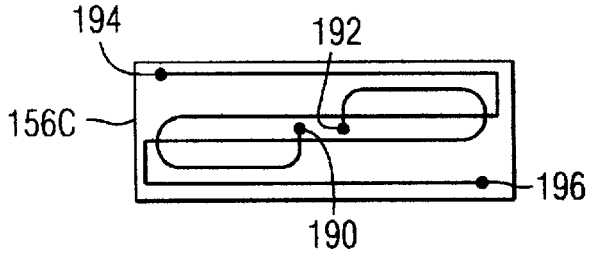
Figure 22:
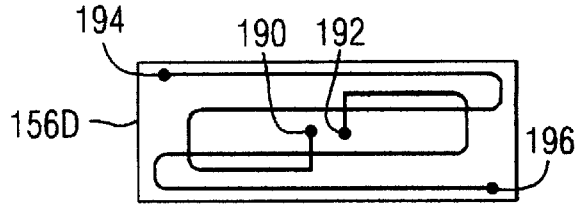
Figure 23:
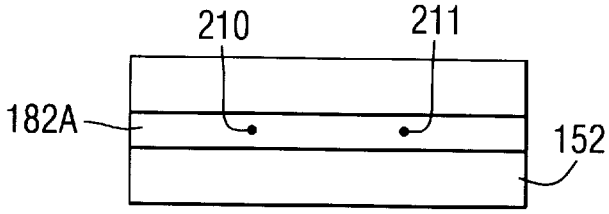
FIGS. 23, 24, 25, 26 and 27 illustrate exemplary radiating elements for the meanderline-loaded antenna of FIG. 18.
Figure 24:
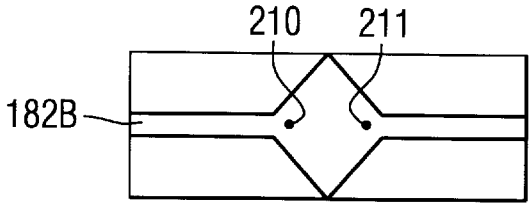
Figure 25:
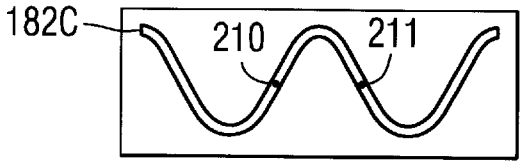
Figure 26:
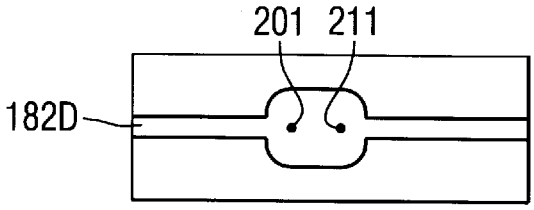
Figure 27:
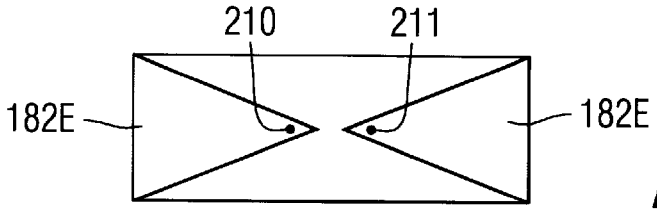

FIGS. 19–22 show cross sectional views along the plane AA of FIG. 18. A first embodiment of the substrate 156 is illustrated in FIG. 19 and referred to by reference character 156A. End points 190 and 192 of, respectively, the horizontal segments 170 and 172 are connected to the radiating element 182 of FIG. 18 via the electrically conductive vertical segments 162 and 164, respectively. An end point 194 of the horizontal segment 170 is connected to the vertical segment 166, which serves as the signal input or output point. An end point 196 of the horizontal segment 172 is connected to ground via the vertical segment 168. Additional differently shaped conductive segments are illustrated in FIGS. 20 through 22. The reference characters 190, 192, 194 and 196 as shown in FIGS. 20, 21 and 22 represent end points that function identically to the same numbered end points in FIG. 19, for the substrates 156B, 156C and 156D. The meanderline embodiments illustrated in FIGS. 19 through 22 are merely exemplary; those skilled in the art recognize that other meanderline shapes can be used depending upon the desired antenna characteristics.

It should be noted that the dielectric substrates 152, 154 and 156 and the horizontal segments 170 and 172 associated therewith can be employed in the meanderline-loaded antenna embodiment of FIGS. 10 and 15. Of course, in FIG. 10 the meanderline couplers 85 and 89 are oriented vertically and thus the dielectric substrates 152, 154 and 156 must also be vertically oriented as applied to the FIG. 10 embodiment. Also, the horizontal segment 170 and 172 would obviously be vertically oriented as applied to the FIG. 10 embodiment. The various end points 190, 192, 194 and 196 associated with the horizontal segments 170 and 172 would have the same functional purpose when applied to the FIG. 10 and FIG. 15 embodiments.

Various embodiments for the radiating element 182 are illustrated in FIGS. 23 through 27 and referred to by reference characters 182A, 182B and 182C, 182D and 182E respectively. In one embodiment, the top plates 182A, 182B, 182C, 182D and 182E are fabricated of copper, although it is well known in the art that other conductive materials can be used in lieu thereof. The vias for connecting the upper segments 162 and 164 of the meanderlines 158 and 160, respectively, are illustrated in FIGS. 23 through 27 and referred to by reference characters 210 and 211. As is known to those skilled in the art, each of the embodiments 182A, 182B, 182C, 182D and 182E imparts certain attributes to the antenna characteristics, including the antenna beam pattern and bandwidth. Additional shapes for the radiating element 182 can include the inverse of the shapes illustrated in FIGS. 23 through 27. By inverse it is meant that copper is disposed on the surface of the substrate in those areas where copper is absent in FIGS. 23 through 27. Additionally, the radiating element 182 can take the shape of any polygon (simple or otherwise), fractal-based curve, or the inverse of such shapes.

Figure 28:
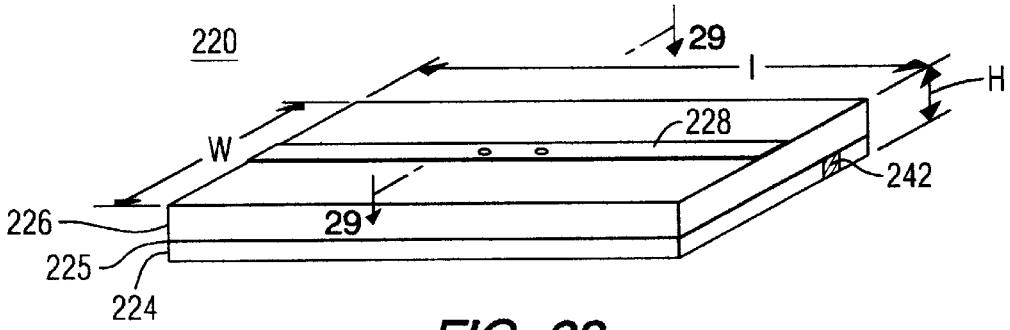
FIGS. 28, 29 and 30 illustrate another low profile meanderline loaded antenna embodiment.
Figure 29:
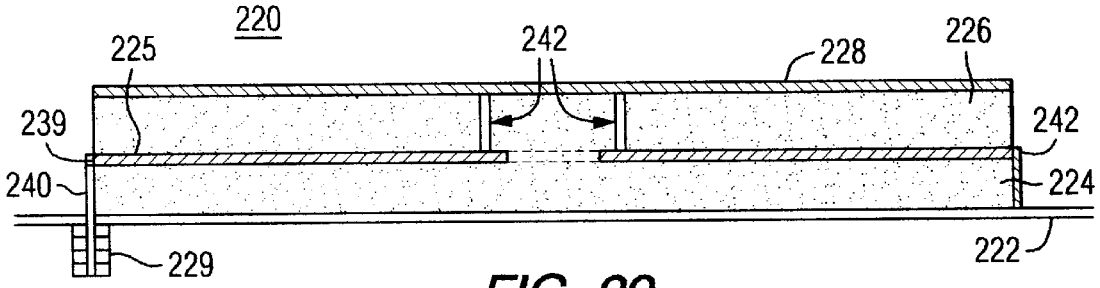
Figure 30:
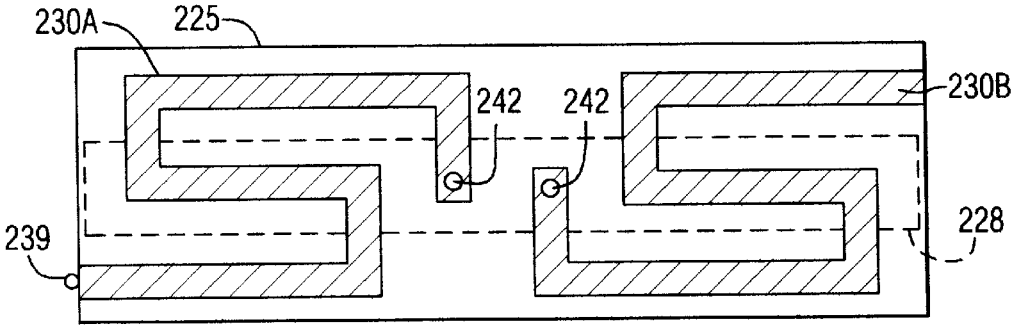

Another low-profile meanderline-loaded antenna 220 is illustrated in FIGS. 28 and 29. FIG. 28 is a perspective view of the meanderline loaded antenna 220 and FIG. 29 is a cross-sectional view along cross-section BB of FIG. 28. The meanderline loaded antenna 220 comprises a ground plane 222, a lower dielectric layer 224, a slow-wave transmission line layer 225, an upper dielectric layer 226 and a top conductor plate 228. A feed point 229 for receiving a signal to be transmitted or for providing the received signal, is also illustrated in FIG. 29. The resonant frequency of the meanderline loaded antenna 220 is adjustable based on the length of slow-wave transmission lines 230A and 230B shown in FIG. 30. The slow-wave transmission lines 230A and 230B are constructed from a conductive material disposed on the low dielectric layer 224 by known printing or etching processes. Generally, the phrase slow-wave transmission line is synonomous with meanderline.

The feed point 229 is conductively connected to the slow-wave transmission line 230A at a point 239 by a conductive member 240 shown in FIG. 29. The opposite end of the slow-wave transmission line 230A is connected to the top conductive or radiating plate 228 by way of a via 242 shown in FIG. 29. The slow wave transmission line 230B is conductively connected to the ground plane 222 by way of a conductive member 242 as shown in FIG. 29. The other end of the slow-wave transmission line 230B is connected to the top conductive plate 228 by way of a via 242. Any of the aforementioned or illustrated shapes can be employed for the top conductive plate 228.

In one embodiment, the meanderline-loaded antenna 220 is 0.7 inches wide, 1.8 inches long and 0.12 inches high. See FIG. 28. One resonant frequency is at about 1.9 GHz. The observed gain is about 3.3 dBi and the front to back gain ratio is about 8 dB. Note that the antenna width and length are short compared to a wave length of the operative frequency. Because the ground plane 222 is closer to the radiating element 228 than in other antenna embodiments, the coupling is increased, which improves the antenna gain performance. In one embodiment of the meanderline-loaded antenna 220, operation in the loop mode discussed above is not necessarily maintained.

Figure 31:
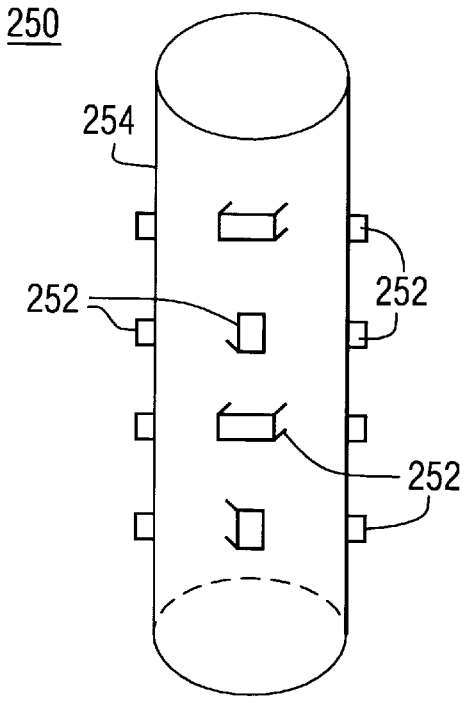
FIGS. 31 and 32 illustrate antenna arrays constructed with the meanderline-loaded antennae of the present invention.

FIG. 31 depicts an exemplary embodiment wherein any of the various embodiments of the meanderline-loaded antennae constructed according to the teachings of the present invention (e.g., meanderline-loaded antennae 80 (FIG. 10), 110 (FIG. 15) 150 (FIG. 18) and 220 (FIG. 28)) are used in an antenna array 250. The individual meanderline antennae, referred to by reference character 252 in FIG. 28, are fixedly attached to a cylinder 254 that serves as the ground plane with separate electrical conductors (not shown in FIG. 31) providing a signal path to each meanderline-loaded antenna 252. Advantageously, the meanderline-loaded antennae 252 are disposed in alternating horizontal and vertically configurations to produce alternating horizontally and vertical polarized signals. That is, the first row of meanderline-loaded antennae 252 are disposed horizontally to emit a horizontally polarized signal in the transmit mode and to receive a horizontally-polarized signal in the receive mode. The meanderline antennae 252 in the second row are disposed vertically to emit or receive vertically polarized signals. Although only four rows of the meanderline-loaded antennae 252 are illustrated in FIG. 31, those skilled in the art recognize that additional parallel rows can be included in the antenna array 250 so as to provide additional gain, where the gain of the antenna array 250 comprises both the element factor and the array factor, as is well known in the art.

Figure 32:
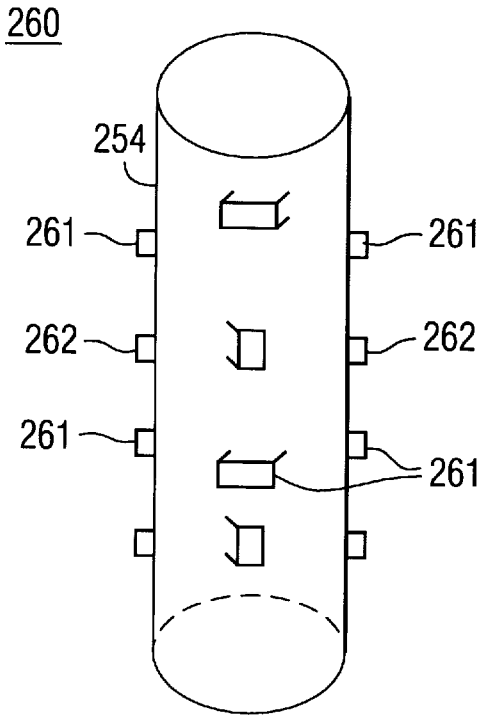

FIG. 32 illustrates yet another antenna array 260 including alternating horizontally oriented elements 261 and vertically oriented elements 262. The horizontally oriented elements 261 and the vertically oriented elements 262 comprise the meanderline-loaded antenna constructed according to the teachings of the present invention (e.g., the meanderline-loaded antenna 80, 110 and 150 and 220). As can be seen, the horizontally oriented elements 261 are staggered above and below the circumferential element centerline from one consecutive row of horizontal elements to the next. Although consecutive vertical elements 262 are shown in a linear orientation, they too can be staggered. Staggering of the elements provides improved array performance.

Although not shown in FIGS. 31 and 32, two meanderline-loaded antennae constructed according to the teachings of the present invention can be oriented at 90 degrees with respect to each other and driven with appropriately phased input signals to produce a circularly polarized signal. Elliptically polarized signals can also be provided by appropriate control over the input signal phases.

While the invention has been described with reference to preferred embodiments, it will be understood by those skilled in the art that various changes may be made and equivalent elements may be substituted for elements thereof without departing from the scope of the present invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a conductive plate;

a first meanderline coupler comprising a first dielectric substrate and a first elongated conductor encircling said first dielectric substrate, said first elongated conductor having a first terminal end responsive to a signal when said antenna is operative in a transmitting mode and for receiving a signal when said antenna is operative in a receiving mode, and further having a second terminal end;

a second meanderline coupler comprising a second dielectric substrate and a second elongated conductor encircling said second dielectric substrate, said second elongated conductor having a first terminal end in electrical connection with said conductive plate and further having a second terminal end;

a top conductive element in electrical connection with the second terminal of said first meanderline coupler proximate a first region of said top conductive element, and in electrical connection with the second terminal of said second meanderline coupler proximate a second region of said top conductive element; and wherein said first and said second meanderline couplers have independently selectable electrical lengths.

2. The antenna of claim 1 wherein the top conductive element is formed from a conductive material and is shaped to produce desired antenna characteristics.

3. The antenna of claim 1 wherein the conductive plate is substantially flat and the top conductive element is substantially parallel thereto.

4. The antenna of claim 1 wherein the distance between the conductive plate and the top conductive element is chosen to achieve certain antenna characteristics.

5. The antenna of claim 1 wherein the sum of the effective electrical length of the conductive plate plus the effective electrical length of the first meanderline coupler plus the effective electrical length of the top conductive element, plus the effective electrical length of the second meanderline coupler presents an approximately resonant condition over a desired frequency band.

6. The antenna of claim 1 wherein the first meanderline coupler and the second meanderline coupler each comprise a folded transmission line.

7. The antenna of claim 1 wherein the first meanderline coupler and the second meanderline coupler have an externally controllable effective length.

8. The antenna of claim 1 having a radiation pattern that is substantially in the azimuth plane at a first frequency.

9. The antenna of claim 1 having a radiation pattern that is substantially in the elevation direction at a second frequency.

10. The antenna of claim 1 wherein the signal to which the first meanderline coupler is responsive in the transmitting mode comprises a plurality of differing frequency signals.

11. The antenna of claim 1 wherein the first meanderline coupler and the second meanderline coupler each comprise a dielectric substrate and a transmission line proximate to said dielectric substrate.

12. The antenna of claim 11 wherein each of the dielectric substrates is in the form of a parallelepiped.

13. The antenna of claim 11 wherein the substrate of the first meanderline coupler and the substrate of the second meanderline coupler are oriented beneath the top conductive element such that the distance between the conductive plate and the top conductive element is minimized.

14. The antenna of claim 11 wherein the transmission line further comprises a conductor, wherein a portion of said conductor encircles the dielectric substrate.

15. The antenna of claim 14 wherein the dielectric substrate of the first and the second meanderline couplers are positioned between the conductive plate and top conductive element, wherein the shortest side of each one of the dielectric substrates is oriented perpendicular to the conductive plate and the top conductive element.

16. The antenna of claim 1 wherein the first and the second meanderline couplers comprise, respectively, a first dielectric substrate having a first conductive trace disposed thereon, and a second dielectric substrate having a second conductive trace disposed thereon, and wherein said first and said second conductive traces include first and second opposing ends, and wherein the first and the second terminals of the first meanderline coupler comprise the first and the second opposing ends of said first conductive trace, and wherein the first and the second terminals of the second meanderline coupler comprise the first and the second opposing ends of said second conductive trace.

17. An antenna comprising:

a conductive plate;

a first conductive element responsive to an input signal when said antenna is in the transmitting mode and for producing a received signal when said antenna is in the receiving mode, said first conductive plate having a first edge;

a second conductive element having a first edge electrically connected to said conductive plate in a substantially orthogonal relationship, said second conductive element further having a second edge parallel to the first edge thereof;

a top conductive element, wherein said first edge of said first conductive element is spaced proximate to a first location on said top conductive element so as to form a gap there between, and wherein said second edge of said second conductive element is spaced proximate to a second location on said top conductive element so as to form a gap there between;

a first meanderline coupler comprising a first dielectric substrate and a first elongated conductor encircling said first dielectric substrate, said first elongated conductor having a first terminal end connected to said first conductive element and having a second terminal end connected to said top conductive element so as to provide an electrical path across the gap therebetween;

a second meanderline coupler comprising a second dielectric substrate and a second elongated conductor encircling said second dielectric substrate, said second elongated conductor having a first terminal end connected to said second conductive element and having a second terminal end connected to said top conductive element so as to provide an electrical path across the gap there between; and wherein operating characteristics of the antenna are dependent upon the effective electrical length of said first and said second meanderline couplers.

18. An antenna comprising:

a first dielectric substrate;

a meanderline layer including a first and a second meanderline transmission line disposed on said first dielectric substrate;

a second dielectric substrate overlying said meanderline layer;

a radiating element disposed on said second dielectric substrate;

wherein said first and said second meanderline transmission lines are conductively connected to said radiating element; and wherein said first meanderline transmission line is responsive to an input signal when said antenna is in a transmitting mode and for providing the received signal when said antenna is in a receiving mode.

19. The antenna of claim 18 wherein the radiating element is shaped to provide certain antenna characteristics.

20. The antenna of claim 18 wherein the first and the second meanderline transmission lines are shaped to provide certain antenna characteristics.

21. The antenna of claim 18 wherein the meanderline layer comprises a dielectric substrate with the first and the second meanderline transmission lines embedded therein.

22. The antenna of claim 18 wherein the first dielectric substrate comprises one or more vias, and wherein each one of the first and second meanderline transmission lines includes a terminal end, and wherein each of said terminal ends passes through a via for conductive connection to the radiating element.

23. An antenna comprising:

a ground plane;

a first dielectric substrate overlying said ground plane;

first and second conductive traces disposed on said first dielectric substrate;

a second dielectric substrate overlying said first and said second conductive traces;

a radiating element disposed on said second dielectric substrate;

wherein a first terminal of each of said first and said second conductive traces are conductively connected to said radiating element; and wherein said first and said second terminal of said second conductive trace is conductively connected to said ground plane, and wherein said second terminal of said first conductive traces is responsive to an input signal when said antenna is in a transmitting mode and for providing the received signal when said antenna is in a receiving mode.

24. The antenna of claim 23 wherein the radiating element is shaped in accord with desired antenna characteristics.

25. The antenna of claim 23 wherein each one of the first and the second conductive traces comprises a slow-wave transmission line.

26. The antenna of claim 23 wherein each one of the first and the second conductive traces has a controllable length.

27. An antenna array comprising:

a ground plane;

a plurality of antenna elements, wherein each antenna element comprises:

a first meanderline coupler comprising a first dielectric substrate and a first elongated conductor encircling said first dielectric substrate, said first elongated conductor having first and second spaced apart terminal ends, wherein said first terminal end is responsive to an input signal when said antenna is in the transmitting mode and for providing a received signal when said antenna is in the receiving mode;

a second meanderline coupler comprising a second dielectric substrate and a second elongated conductor encircling said second dielectric substrate, said second elongated conductor having first and second spaced apart terminal ends, wherein said first terminal end is in electrical connection with said ground plane;

a top conductive element in electrical connection with said second terminal end of said first meanderline coupler and in electrical connection with said second terminal end of said meanderline coupler; and wherein said first and said second meanderline couplers have independent selectable electrical lengths.

28. The antenna array of claim 27 wherein a first number of the plurality of antenna elements are oriented for vertical polarization, and wherein a second number of the plurality of antenna elements are oriented for horizontal polarization.

29. The antenna array of claim 28 wherein the first number of the plurality of antenna element includes four antenna elements spaced circumferentially at a spacing of 90 degrees.

30. The antenna array of claim 28 wherein the second number of the plurality of antenna elements includes four antenna elements spaced circumferentially at a spacing of 90 degrees.

31. The antenna array of claim 27 wherein the ground plane is cylindrically shaped, and wherein a first number of the plurality of the antenna elements are spaced circumferentially around the ground plane at a first axial location, and wherein a second number of the plurality of antenna elements are spaced circumferentially around the ground plane at a second axial location, spaced apart from said first axial location.

32. The antenna array of claim 27 wherein the ground plane is cylindrically shaped and wherein a first number of the plurality of the antenna elements are spaced circumferentially around the ground plane such that all of the second number are staggered about a first axial location, and wherein a second number of the plurality of the antenna elements are spaced circumferentially around the ground plane at a second axial location, spaced apart from said first axial location.

33. An antenna array comprising;

a ground plane;

a plurality of antenna elements, wherein each antenna elements comprises:

a first dielectric substrate;

a meanderline layer, including a first and a second conductive trace, disposed on said first dielectric substrate;

a second dielectric substrate overlying said meanderline layer;

a radiating element disposed on said second dielectric substrate;

wherein said first and said second conductive traces are conductively connected to said radiating element at a first terminal of each of said first and said second conductive traces;

wherein a second terminal of said second conductive trace is connected to said ground plane; and wherein a second terminal of said first conductive trace is responsive to an input signal when said antenna is in a transmitting mode and for providing the received signal when said antenna is in a receiving mode.

34. An antenna array comprising:

a ground plane;

a plurality of antenna elements, wherein each antenna element comprises:

a first dielectric substrate;

first and second conductive traces disposed on said first dielectric substrate;

a second dielectric substrate overlying said first and said second conductive traces;

a radiating element disposed on said second dielectric substrate;

wherein a first terminal of each one of said first and said second conductive traces is conductively connected to said radiating element;

wherein a second terminal of said second conductive trace is connected to said ground plane;

wherein a second terminal of said first conductive trace is responsive to an input signal when said antenna is in a transmitting mode and for providing a received signal once the antenna is in a receiving mode;

wherein the permittivity of the second dielectric substrate is less than the permittivity of said first dielectric substrate.

35. The antenna array of claim 34 wherein the radiating element of each of the plurality of antenna elements is shaped to provide certain antenna characteristics.

36. The antenna array of claim 34 wherein the first and the second conductive traces of each one of the plurality of antenna elements is shaped to provide certain antenna characteristics.

* * * * *